US009179716B2

(12) United States Patent
Forbes et al.

(10) Patent No.: US 9,179,716 B2
(45) Date of Patent: Nov. 10, 2015

(54) ADJUSTABLE FRONT-OPENING HOSPITAL GOWN

(71) Applicant: Henry Ford Health System, Detroit, MI (US)

(72) Inventors: Michael P. Forbes, Livonia, MI (US); Patrick Houin, Grosse Pointe Shores, MI (US); Frantz Mondesir, North Miami, FL (US); Callie Clark, Livonia, MI (US)

(73) Assignee: Henry Ford Health System, Detroit, MI (US)

( * ) Notice: Subject to any disclaimer, the term of this patent is extended or adjusted under 35 U.S.C. 154(b) by 0 days.

(21) Appl. No.: 13/834,877

(22) Filed: Mar. 15, 2013

(65) Prior Publication Data

US 2013/0276202 A1 Oct. 24, 2013

Related U.S. Application Data

(60) Provisional application No. 61/637,528, filed on Apr. 24, 2012.

(51) Int. Cl.
*A41D 13/00* (2006.01)
*A41D 13/12* (2006.01)

(52) U.S. Cl.
CPC ..... *A41D 13/1236* (2013.01); *A41D 13/1281* (2013.01)

(58) Field of Classification Search
CPC ..... A41D 13/1236; A41D 13/1245; A41D 13/1281; A41D 13/129
USPC ..... 2/114, 96, 83, 74, 75, 76
See application file for complete search history.

(56) References Cited

U.S. PATENT DOCUMENTS

| | | | | | |
|---|---|---|---|---|---|
| 2,260,168 | A | * | 10/1941 | Costanza | 2/76 |
| 2,331,051 | A | * | 10/1943 | Severance | 2/114 |
| 2,556,931 | A | * | 6/1951 | Miller | 2/114 |
| 2,668,294 | A | * | 2/1954 | Gilpin | 2/114 |
| 3,397,406 | A | * | 8/1968 | Leach | 2/96 |
| 3,490,072 | A | * | 1/1970 | Keltner | 2/114 |
| 3,557,385 | A | * | 1/1971 | Hendrickson | 2/114 |
| 3,889,414 | A | * | 6/1975 | Whetzel | 446/394 |
| 4,422,186 | A | * | 12/1983 | Loney | 2/114 |
| 4,434,511 | A | * | 3/1984 | Weiser | 2/114 |
| 4,570,268 | A | * | 2/1986 | Freeman | 2/114 |
| 4,683,594 | A | * | 8/1987 | Feinberg | 2/105 |
| 4,686,715 | A | * | 8/1987 | Price | 2/114 |
| 4,698,848 | A | * | 10/1987 | Buckley | 2/114 |
| 4,718,124 | A | * | 1/1988 | Sawicki et al. | 2/114 |
| 4,754,500 | A | * | 7/1988 | Brucato et al. | 2/105 |

(Continued)

*Primary Examiner* — Richale Quinn
(74) *Attorney, Agent, or Firm* — Quinn Law Group, PLLC

(57) ABSTRACT

A front-opening hospital gown includes first and second front panels. The first front panel overlaps the second front panel when the gown is worn by a patient. The second front panel has fasteners in multiple columns and rows. The first front panel has mating fasteners, for instance a single column of multiple rows. The number of rows on the front panels may be equal. An additional rear panel(s) defines an elongated slot on the back of the gown for access to the patient's back. The gown may include an anti-microbial coating, colored fabric that indicates the size of the gown, an RFID tag, color-coded intravenous access flaps, and a telemetry pocket. The intravenous access flaps may have color-coded fasteners or backing twill material. The gown may include a collar indicating the front of the gown. The collar may have a contrasting color relative to a color of the panels.

16 Claims, 3 Drawing Sheets

(56) References Cited

U.S. PATENT DOCUMENTS

| | | | | |
|---|---|---|---|---|
| 4,864,657 | A * | 9/1989 | Lake | 2/114 |
| 4,920,578 | A * | 5/1990 | Janzen et al. | 2/114 |
| 5,084,914 | A * | 2/1992 | Hesch | 2/79 |
| 5,093,932 | A * | 3/1992 | Doyle | 2/114 |
| 5,184,351 | A * | 2/1993 | Benstock | 2/114 |
| 5,652,962 | A * | 8/1997 | Patnode | 2/114 |
| 5,946,722 | A * | 9/1999 | Trautmann | 2/83 |
| 6,484,321 | B1 * | 11/2002 | Shamam | 2/114 |
| 6,574,800 | B1 * | 6/2003 | Leger et al. | 2/114 |
| 7,305,716 | B1 * | 12/2007 | Richards | 2/114 |
| 7,424,750 | B2 * | 9/2008 | Kerr | 2/114 |
| 8,302,214 | B2 * | 11/2012 | McGrath | 2/114 |
| 2002/0152535 | A1 * | 10/2002 | Gaza | 2/114 |
| 2003/0131401 | A1 * | 7/2003 | Dilworth et al. | 2/457 |
| 2004/0010837 | A1 * | 1/2004 | Graves | 2/114 |
| 2007/0271675 | A1 * | 11/2007 | Eraca | 2/104 |
| 2010/0095424 | A1 * | 4/2010 | Grgich et al. | 2/104 |
| 2010/0125930 | A1 * | 5/2010 | Burrell, IV | 2/75 |
| 2011/0231981 | A1 * | 9/2011 | Appel et al. | 2/114 |
| 2012/0054946 | A1 * | 3/2012 | Griffith et al. | 2/400 |

* cited by examiner

ADJUSTABLE FRONT-OPENING HOSPITAL GOWN

CROSS REFERENCE TO RELATED APPLICATIONS

This application claims the benefit of U.S. Provisional Patent Application No. 61/637,528 filed on Apr. 24, 2012, which is hereby incorporated by reference in its entirety.

TECHNICAL FIELD

The present disclosure relates to an adjustable front-opening hospital gown.

BACKGROUND

Rear-opening hospital gowns are typically worn by patients in hospitals and outpatient medical facilities. The thin, lightweight cotton design of a conventional rear-opening hospital gown, which is loosely secured in the back via one or more fabric ties, allows an attending physician or nurse to easily access a patient's chest, shoulder, and back areas from the rear of the gown. Such gowns are inexpensive and easily laundered. As a result, conventional hospital gown designs have not changed much over the years, and are generally considered to be both cost and functionally effective from the perspective of a medical practitioner. However, from the perspective of a patient wearing a conventional rear-opening hospital gown, the patient is often left with a compromised sense of privacy and comfort.

SUMMARY

An adjustable front-opening hospital gown is disclosed herein which provides an improved level of comfort and enhanced patient privacy relative to the conventional rear-opening hospital gowns described above. In particular, the gown includes first and second front panels each having respective first and second sets of fasteners. The first front panel overlaps the second front panel when worn by a patient so as to allow each fastener of the first set of fasteners to engage a corresponding one of the second set of fasteners. The positioning of the fasteners on the gown may enable most or all of the fasteners to be hidden from view, thus providing an aesthetically pleasing appearance. A collar or other suitable orientation features clearly identifies the front of the gown to assist the patient in putting on the gown.

The hospital gown disclosed herein also includes at least one additional rear panel. The rear panel(s) is connected to the first and second front panel to form the back of the gown. An elongated rear slot is defined between seams of the additional rear panels, which allows a medical practitioner to easily access the patient's back area without removing the gown, for instance to facilitate use of a stethoscope. The gown may also include a telemetry pocket and/or intravenous access flaps, the latter of which may be configured with certain color-coded features as set forth below to further aid the patient in assembling and wearing the gown.

In a particular embodiment, the first set of fasteners may include a single column of fasteners such as snap studs, while the second set of fasteners may include multiple columns of mating fasteners such as snap sockets. The first and second sets of fasteners may be optionally arranged in an equal number of rows, e.g., three or more rows, with at least twice as many fasteners in the second set as in the first.

In an alternate configuration, the first set of fasteners may be a set of shaped tabs extending from an edge of the first front panel. The second set of fasteners may be mating set of shaped slots formed in the second front panel, e.g., either as elongated through-holes or shaped slots arranged on a face of the gown. Each slot in this configuration receives and secures a corresponding shaped tab.

The hospital gown of the present invention may be optionally treated with an anti-microbial coating, and/or formed in part using a colored fabric that indicates the size of the gown. Other color-coded features may be included. For example, some/all of the fasteners used with the present gown may be color-coded, and/or the backing of a strip of twill material securing the fasteners to the gown may be color-coded. In a possible embodiment, the fasteners and/or the twill material forming the IV access flaps on the two sides of the gown, i.e., on the patient's left and right shoulders, may be constructed with a corresponding color so that a disassembled gown may returned from the laundry, given to a patient or department , and easily reassembled by matching up the colors.

The above features and advantages and other features and advantages of the present invention are readily apparent from the following detailed description of the best modes for carrying out the invention when taken in connection with the accompanying drawings.

Figure 1:
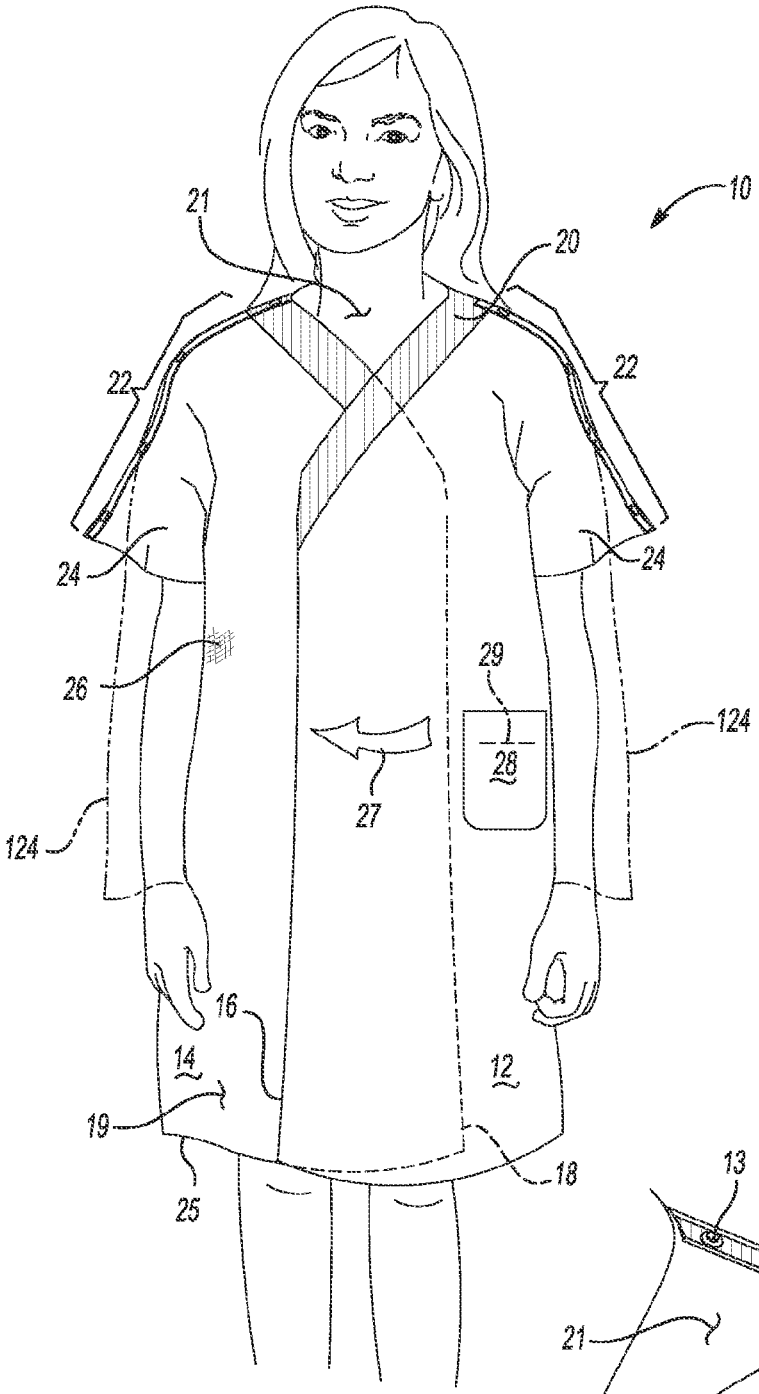
FIG. 1 is a schematic front view illustration of an adjustable front-opening hospital gown in accordance with the present invention.

2A is a schematic front view illustration of the gown of FIG. 1 showing an alternative fastener embodiment.

Figure 2A:
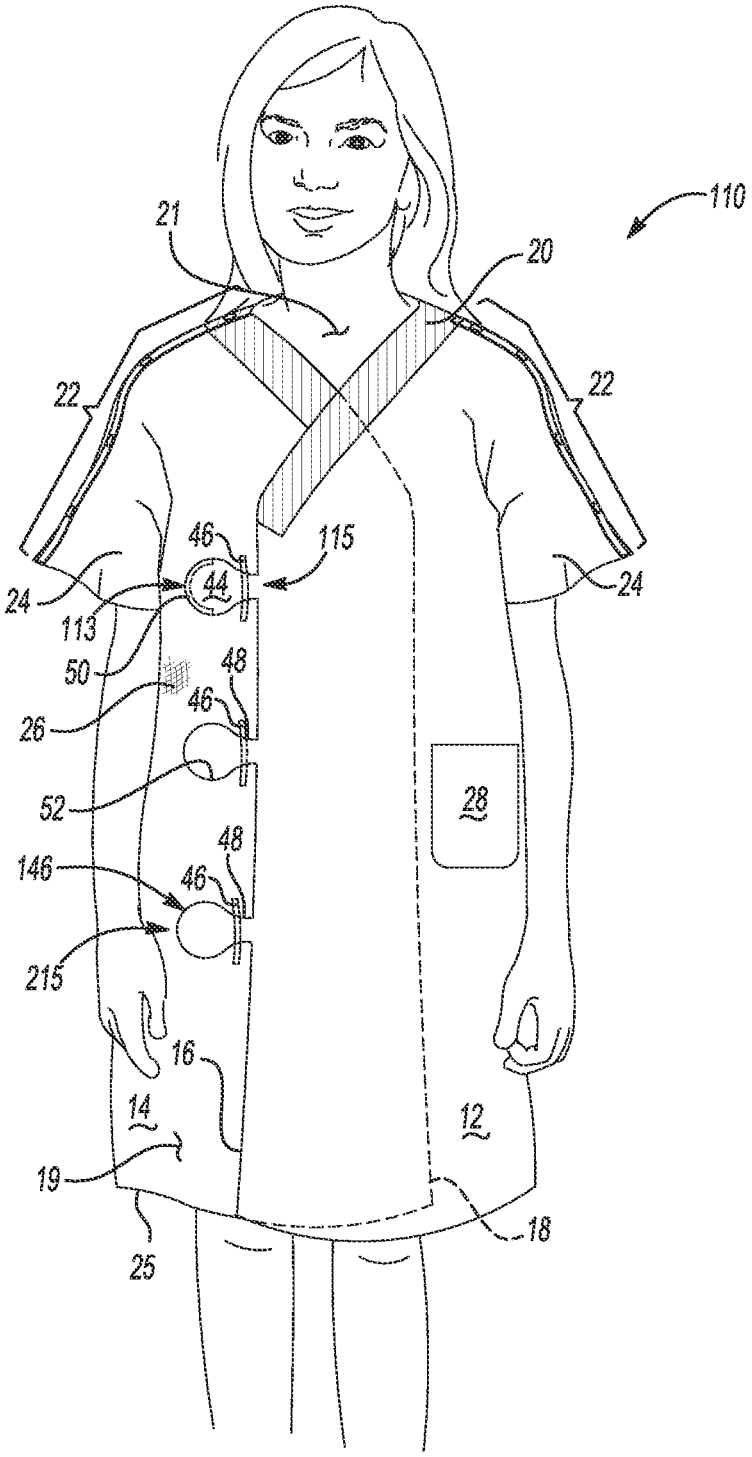
FIG. 2 is a schematic illustration of the gown of FIG. 1 in an open state illustrating an example fastener embodiment.
Figure 2:
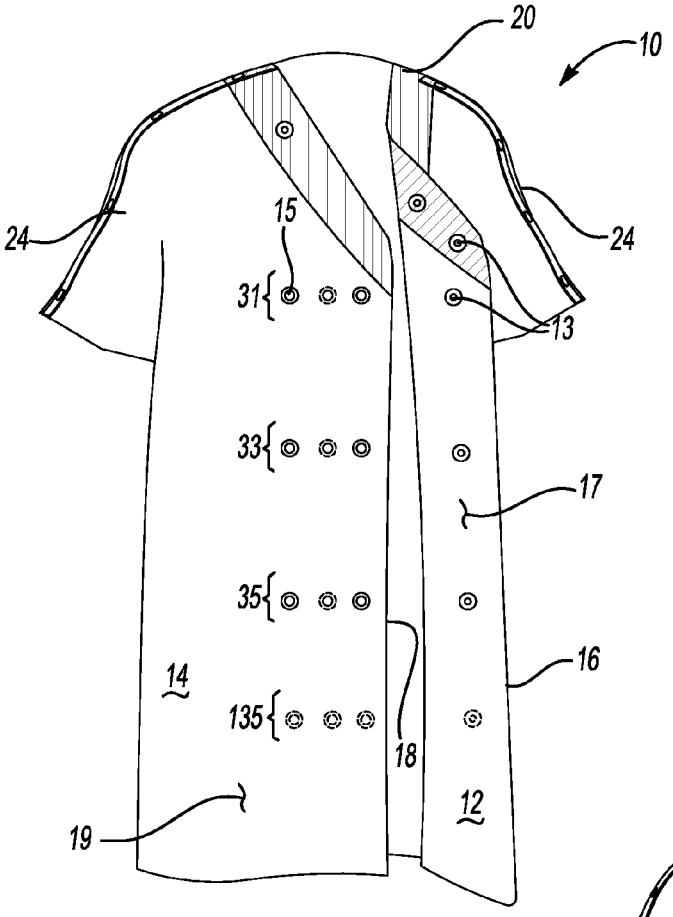
Figure 3:
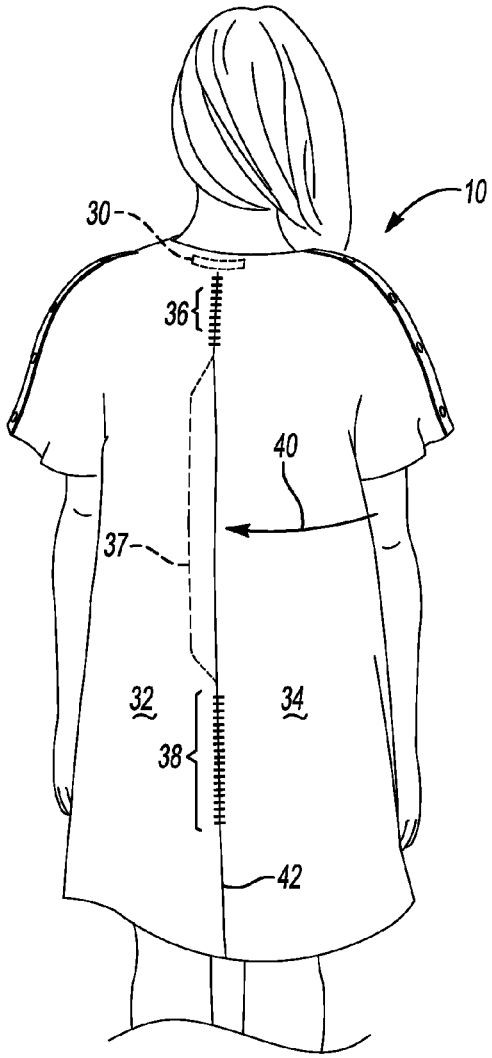

FIG. 3 is a schematic rear view illustration of the gowns shown in FIGS. 1, 2, and 2A.

DETAILED DESCRIPTION

Referring to the drawings, wherein like reference numbers refer to like components throughout the several views, a front view of an example adjustable front-opening hospital gown 10 is shown schematically in FIG. 1. The front-opening design of the gown 10 with its various additional features is intended to provide improved levels of patient privacy and comfort relative to the types of conventional rear-opening hospital gowns noted above. Extra privacy is provided without compromising a physician's access to the patient's chest, back, and shoulder areas. The presently disclosed front-opening design also allows the patient to easily put on the gown 10 and adjust the fit of the gown 10 to conform to the wearer's own body and privacy preferences as set forth in detail below.

The hospital gown 10 of FIG. 1 includes respective first and second front panels 12 and 14. The first and second front panels 12 and 14 are constructed from a fabric or combination of different fabrics which are sufficiently suitable for the intended use, including resilience to repeated high-temperature laundering. Example fabric types include, but are not necessarily limited to, polyester/nylon, polyester/cotton, cotton/nylon, cotton, polyester/silk, and/or silk/nylon. Optionally, a moisture wicking material may be used in part or all of the gown 10 to further increase patient comfort. Silk, which is capable of rapidly reaching body temperature and maintaining this temperature at a constant level, may be used for this purpose in an example configuration. The use of moisture wicking material may, by way of example, help to reduce the excessive perspiration that is common in infants, children, and adults affected by a fever or eczema. Thus, the gown 10, when made at least partially of silk, may help to protect the patient's skin from a loss of moisture which otherwise can aggravate skin dryness.

The respective first and second front panels 12 and 14 of the hospital gown 10 shown in FIG. 1 are respectively joined to pair of rear panels 32 and 34 (see FIG. 3), or in the alternative to a single/combined rear panel. A portion of an outer surface 19 of the second front panel 14 may be overlapped by the first front panel 12 in the direction of arrow 27 when the gown 10 is properly worn by a patient.

The hospital gown 10 includes a collar 20 or other suitable feature on the front of the gown 10 as shown. The collar 20 orients a patient as to which side of the gown 10 is the front and which side is the rear. As is well known in the art, lightweight cotton rear-opening gowns are used almost universally in hospitals and other medical facilities. Thus, a patient attempting to wear the present front-opening gown 10 of FIG. 1 may be confused at first by its unconventional front-opening design. The collar 20 is thus intended to allow the patient to determine at a glance how the gown 10 is to be worn.

The collar 20 may be a faux or decorative design such as a point collar (not shown), i.e., a collar that is similar in appearance to the types of collars used on a dress shirt, or the collar 20 may be a fully functional collar. Other possible orientation features exist that are not collars. For instance, an orientation feature such as a tab (not shown) may be sewn to one or both of the respective first and second front panels 12 and 14 and labeled with a suitable identifier such as the word "front", a universally recognized symbol, a color, and/or any other suitable marker.

In the particular embodiment shown in FIG. 1, the collar 20 is formed from a strip of fabric providing sufficient contrast in color and/or fabric type to the rest of the hospital gown 10. Much like the upper edge of a conventional bed sheet, the collar 20 may be formed of a different, softer type of material than that used to form the remainder of the gown 10, and may be sewn to the edges of the first and second front panels 12 and 14. In an example configuration, the respective first and second front panels 12 and 14, as well as the rear panels 32 and 34 of FIG. 3, may be constructed from a lighter colored material such as white or pale blue, both of which are conventionally used in medical facilities, while the collar 20 is constructed from a darker blue material. In other embodiments, the color of the fabric used for the collar 20 may correspond to the size of the gown 10, e.g., blue for medium, green for large, etc. In this manner, a patient may identify an appropriately sized gown 10 at a glance without having to try it on.

The hospital gown 10 shown in FIG. 1 may include various other features, including for instance a telemetry pocket 28 formed in or on one of the first or second front panels 12 or 14, or otherwise placed in a position that is readily accessible by a medical practitioner. As is well understood in the art, a telemetry pocket such as the example telemetry pocket 28 of FIG. 1 is specially configured to hold a telemetry device or other medical device. The telemetry pocket 28 includes at least one interior slit 29 which allows lead wires from any medical device contained in the telemetry pocket 28 to be routed to the patient's torso 21 or other desired position beneath the gown 10.

As shown in FIG. 1, a primary edge 16 of the first front panel 12 aligns vertically with the length of the patient's torso 21 when worn by the patient. A similar primary edge 18 of the second front panel 14 as shown in phantom is overlapped by the first front panel 12 when the hospital gown 10 is worn as intended. While a right-handed orientation is shown for the gown 10 in FIG. 1, those of ordinary skill in the art will appreciate that left-handed gowns 10 may be easily constructed within the scope of the present invention. In such an embodiment, the function and structure of the respective first and second front panels 12 and 14 is simply reversed, i.e., with the second front panel 14 overlapping the first front panel 12. For illustrative consistency, the right-handed example embodiment of FIG. 1 will be described hereinafter.

Still referring to FIG. 1, the hospital gown 10 may include a lower hem seam 25 at the approximate knee level of the patient as shown. However, other hem seam levels may be provided without departing from the intended inventive scope, for instance to meet increased privacy or comfort standards of certain patients. The level of the lower hem seam 25 is typically static, and thus the actual hem level will depend on the size of the gown 10 and, during construction, the length of the various panels 12, 14, 32, and 34 forming the gown 10.

In a possible configuration, different sizes of the hospital gown 10 may be provided for different patients, with each size constructed at least in part of a fabric having a designated color. Each color in such a color-coded gown 10 may correspond to a different gown size. For instance, small, medium, large, and extra large gowns 10 may be constructed at least partially of yellow, red, green, and blue fabric, respectively. Such colors may be, for instance, woven into a base fabric color such as white, possibly in a unique pattern or using a repeated logo such as a name or logo of a particular facility, or the entire gown 10 of a given size may be formed from fabric of a designated color. The use of a name/logo may help a given facility to uniquely identify the particular department or facility having ownership of the gown 10, and thus help reduce inventory shrinkage.

Optionally, an anti-microbial coating 26 may be applied to the hospital gown 10. The anti-microbial coating 26 forms a barrier against certain types of pathogens that may encountered in a medical facility. Various commercially available coatings may be used. One possible anti-microbial coating 26 is FabricAide®, a product that is offered commercially by Coating Specialists LLC of Auburn Hills, Mich. The anti-microbial coating 26 is shown schematically on only a portion of the gown 10 for illustrative simplicity. Those of ordinary skill in the art will appreciate that the anti-microbial coating 26 would cover the entirety of the gown 10, or at least substantial exposed portions thereof, depending on the intended design and use.

The hospital gown 10 shown in FIG. 1 may also include sleeves 24, which may be defined by the material of the rear panels 32 and 34 of FIG. 3 in conjunction with the front panels 12 and 14 of FIG. 1. While a conventional short to medium length sleeve length design is shown in the various Figures, longer sleeves 124 may be provided in some embodiments. The optional longer sleeves 124, which are shown in phantom in FIG. 1, would allow patients with particular privacy and/or religious standards to cover more of the surface area of their arms. The longer sleeves 124 would also provide improved skin coverage to patients who are elderly, ill, immune-compromised, or otherwise relatively sensitive to colder temperatures.

The shoulder areas of the sleeves 24 of FIG. 1 may include intravenous access flaps 22. The intravenous access flaps 22 may be closed via metal or plastic snaps or any other suitable fasteners, as is well understood in the art. One side of the hospital gown 10, such as the first front panel 12, may be designed such that the intravenous access flap 22 on that particular side does not fully unsnap, e.g., by using stitching extending from the neck of the gown 10 down to the intravenous access flap 22. The presence of the intravenous closure flaps 22 that fully open on the other side of the gown 10, e.g., the second front panel 14, allows the gown 10 to be quickly removed if needed. That is, one side of the gown 10 opens fully to allow the gown 10 to be removed.

Figure 1A:
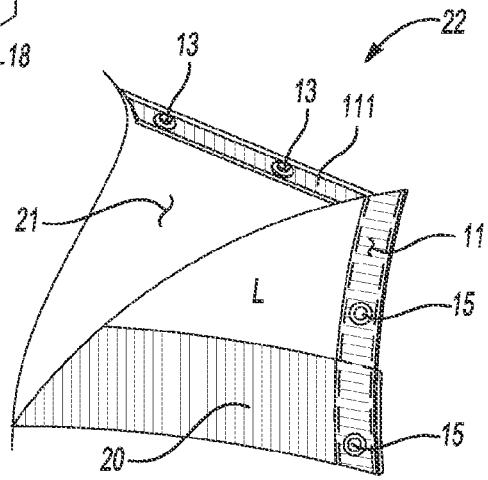
FIG. 1A is a schematic perspective view illustration of a portion of a color-coded collar and intravenous access flap of the gown shown in FIG. 1.

Referring briefly to FIG. 1A, the intravenous access flaps 22 on a given side of the hospital gown 10 of FIG. 1 may be constructed with fasteners 13, 15 and/or backing strips of twill material 11, 111 of like or matching colors, for instance plastic or anodized steel or aluminum snaps of a given color. Alternatively, the fabric of the twill material 11, 111 may be of the same color on a given one side of the gown 10 of FIG. 1, but different from the color on the other intravenous access flap 22. For example, on the patient's left (L) shoulder as shown, with the torso 21 shown as exposed when the intravenous access flap 22 is opened, the twill material 11, 111 may be blue, while on the patients right shoulder the twill material 11, 111 may be white, thus minimizing the chance that a patient will connect the fasteners 13 or 15 of one intravenous access flap 22 to the mating fasteners 13 or 15 of the other intravenous access flap 22. Such a design feature may allow the gown 10, when returned from the laundry and given to a patient, to be folded in a logical manner to facilitate later assembly of the gown 10.

Referring to FIG. 2, the first front panel 12 of the hospital gown 10 includes an inner surface 17 having a first set of the fasteners 13. The outer surface 19 of the second front panel 14 is likewise equipped with a mating second set of fasteners 15. For example, the fasteners 13 may be embodied as snap studs of the type known in the art, with the fasteners 15 embodied as mating snap sockets. Such snap fasteners are relatively easy to engage and disengage by patients having normal levels of finger dexterity, and also tend to withstand repeated laundering in hot water that hospital gowns are subjected to. However, other fastener types may be used without departing from the intended inventive scope.

As alternative examples, the fasteners 13 may be constructed as button holes or loops that are respectively cut or sewn in the first front panel 12, while the fasteners 15 may be mating buttons or posts sewn to the second front panel 14. Alternatively, the two sets of fasteners 13 and 15 may be configured as hook-and-loop fasteners or any other suitable design. The fasteners 13 and 15 may be reversed in other embodiments, i.e., with the fasteners 13 provided on the second front panel 14 and the fasteners 15 provided on the first front panel 12. Such an embodiment may help to ensure that all of the fasteners 13 and 15 are sufficiently hidden from view when the gown 10 is worn by the patient.

In the example embodiment of FIG. 2, the first set of fasteners 13 is arranged in a single column of multiple rows, e.g., three or more rows each having a single fastener 13. The second set of fasteners 15 may be arranged in two or more columns, and may include an equal number of rows of mating fasteners, e.g., three rows 31, 33, and 35 of three fasteners 15 each as shown, or at least one additional row 135 as shown in phantom. Thus, a patient wearing the hospital gown 10 may be provided with a variable and highly customizable fit. While up to four different rows are shown in the example embodiment of FIG. 2, more or fewer rows may be provided without departing from the intended inventive scope.

When the three rows 31, 33, and 35 shown in FIG. 2 are used, with each row 31, 33, and 35 having three columns/possible fastener positions, a total of 27 different possible fit variations are enabled. The flexibility of fit of an adjustment of the hospital gown 10 therefore allows the gown 10 of a given size to be used across a wide range of body styles. The adjustable front-opening design of the gown 10 also provides enhanced privacy relative to that afforded by conventional gowns, which may be an essential consideration for some patients.

Referring to FIG. 2A, in an alternative adjustable front-opening hospital gown 110, the fasteners 13 and 15 described above with reference to FIG. 2 may be embodied as alternative fasteners 113, 115. In this embodiment, the fasteners 113 may be configured as a set of shaped tabs 44. The fasteners 115 may be configured as a set of mating linear slots 46. The shaped tabs 44 include a trailing edge 48, which may define a narrowed portion or neck of the shaped tab 44. The profile may be teardrop shaped as shown, arrow shaped, or any other shape that can engage the slots 46 and retain the first front panel 12 with respect to the second front panel 14.

The shaped tabs 44 may extend outward from the edge 16 of the first front panel 12, and may be attached to or formed integrally with the material of the first front panel 12. The trailing edge 48 may engage the material of the second front panel 14 adjacent to the mating linear slot 46 to thereby prevent the tabs 44 from releasing from the mating linear slot 46. The shaped tabs 44 may be stiffened with a suitable stiffening feature 50, for instance starch and/or a stiffened panel insert. Use of the stiffening feature 50 provides rigidity needed for insertion of the tabs 44 into the linear slots 46.

Also shown in FIG. 2A is an interlocking fastener design that may be used in yet another alternative. In this embodiment, the first front panel 12 may still include the shaped tabs 44. The tabs 44 may be reinforced with silicone rubber and covered with fabric to provide sufficient rigidity and flexibility. The second front panel 14 may define, as an alternative second set of fasteners 215, mating shaped slots 146 having a perimeter edge 52. The perimeter edge 52 defines a shape that is the same as the teardrop or other shape of the shaped tabs 44. Similar to the functional design of a jigsaw puzzle, the shaped tabs 44 in this configuration snap into the notches of the second set of fasteners 215 to thereby interlock the edge 16 of the first front panel 12 with the perimeter edge 52.

Referring to FIG. 3, access to the patient is provided at the rear of the hospital gown 10 between the rear panels 32 and 34, or via a single rear panel in another possible embodiment. For example, the rear panels 32 and 34 may be sewn together at the top and bottom of the gown 10 to form respective top and bottom seams 36 and 38. Material between the top and bottom seams 36 and 38 is not sewn together or otherwise joined, thus defining an elongated slot, which is identified at 40, through which an attending physician or nurse can easily access the patient's back area. The bottom seam 38 may be terminated short of the hem seam 25 (see FIG. 1) as shown to facilitate movement and comfort of a patient wearing the gown 10. Likewise, the seams 36, 38 and the elongated slot 40 may or may not be oriented serially or end-to-end as shown. For instance, for added comfort any or all of the seams 36, 38 and the elongated slot 40 may be angled relative to each other, and thus with respect to the patient's spine, for improved sitting comfort.

The elongated slot 40 may be sized and shaped to enable such access without the patient having to remove the gown 10. For instance, in a non-limiting example embodiment the length of the elongated slot 40 may be about 10 to 14 inches, a size which would comfortably receive a normal sized hand, stethoscope listening piece, etc. The presence of the intravenous access flaps 22 also enables additional access to the patient from the rear of the gown 10 if needed. The rear panel 34 may have an edge 37 that is overlapped by the other rear panel 32, e.g., solely within the elongated slot 40. Thus, when access to the patient's back area is not required, the elongated slot 40 remains closed to provide added privacy and comfort. An additional slot 42 may be defined by the rear panels 32, 34 below the seams 36, 38 and below the elongated slot 40 as shown. The additional slot 42 may help to improve mobility and comfort of the patient while wearing the gown 10.

In an optional configuration, a remote frequency identification (RFID) tag 30 or another identifying security device may be sewn into the hospital gown 10 or 110 (see FIG. 2A), e.g., in proximity to the collar 20 of FIGS. 1 and 2. Use of the optional RFID tag 30 may enable the gowns 10 to be remotely monitored, tracked, and inventoried within a given facility. That is, different departments such as maternity or cardiology may require a gown 10 having a particular feature set that is unique relative to other departments. Customized gowns 10 may be used in such departments, with the use of such gowns 10 restricted to those departments. Such a use may be facilitated by the example RFID tag 30. Likewise, inventory shrinkage may be reduced for the facility as a whole using such a security option.

While the best modes for carrying out the invention have been described in detail, those familiar with the art to which this invention relates will recognize various alternative designs and embodiments for practicing the invention within the scope of the appended claims.

The invention claimed is:

1. An adjustable front-opening hospital gown comprising:

a first front panel having a first set of fasteners;

a second front panel having a second set of fasteners that exceeds the first set of fasteners in count or number to thereby facilitate adjustability of the hospital gown, wherein the first front panel is configured to overlap part of the second front panel and thereby define a front of the hospital gown with respect to a patient when the hospital gown is worn by the patient, and wherein each of the first set of fasteners is configured to engage with a corresponding one of the second set of fasteners;

a rear panel connected to the first and second front panels, wherein the rear panel includes a first rear panel and a second rear panel joined together to form a pair of seams, and defines an elongated slot defined by material between the pair of seams that is not joined together, wherein the elongated slot is located between the pair of seams of the rear panel, and wherein the rear panel further defines a pair of sleeves in conjunction with the first and second front panels;

a pair of intravenous access flaps each positioned with respect to a corresponding one of the sleeves, wherein each of the pair of intravenous access flaps is color-coded to identify a corresponding one of the sleeves; and a collar positioned only on the front of the hospital gown, wherein the collar is a strip of fabric material sewn to the first and second front panels and configured to contrast with the material of the first and second front panels and the rear panel to thereby identify the front of the hospital gown;

wherein the first rear panel includes an edge that is overlapped by the second rear panel within the elongated slot to close the elongated slot.

2. The hospital gown of claim 1, further comprising additional fasteners positioned adjacent to and configured to close the pair of intravenous access flaps.

3. The hospital gown of claim 2, wherein the pair of intravenous access flaps each includes a corresponding strip of twill material of a respective first and second color forming a backing for the additional fasteners, and wherein the first color is sufficiently different from the second color such that the corresponding sleeve is identified.

4. The hospital gown of claim 1, wherein the first set of fasteners is arranged in a single column of multiple rows, and wherein the second set of fasteners is arranged in at least two columns each having a number of rows that is equal to the number of multiple rows of the first set of fasteners.

5. The hospital gown of claim 4, wherein the second set of fasteners is arranged in exactly two of the columns and in exactly four of the rows.

6. The hospital gown of claim 1, further comprising a telemetry pocket positioned with respect to either the first front panel or the second front panel.

7. The hospital gown of claim 1, wherein:

the collar is constructed of a first fabric material having a first color;

the first and second front panels are constructed of a second fabric material having a second color;

the first color is darker than the second color such that the first color sufficiently contrasts with the second color to identify the front of the hospital gown.

8. The hospital gown of claim 1, wherein an additional slot is defined by the first and second rear panels below the pair of seams and below the elongated slot.

9. The hospital gown of claim 1, further comprising an anti-microbial coating.

10. The hospital gown of claim 1, wherein each of the pair of sleeves extends to a wrist of the patient when the hospital gown is worn by the patient.

11. An adjustable front-opening hospital gown comprising:

a first front panel having a single column of at least three rows of fasteners in the form of snap studs;

a second front panel that includes two columns of fasteners in the form of snap sockets to thereby facilitate adjustability of the hospital gown, wherein:

a telemetry pocket covering a slit in the hospital gown is included on at least one of the first and second front panels;

each of the two columns has a number of rows that is equal in count or number to the count or number of rows of the snap studs;

the snap studs are configured to engage a corresponding one of the snap sockets; and the second front panel is partially overlapped by the first front panel to thereby define a front of the hospital gown with respect to the patient when the hospital gown is worn by the patient;

a first and a second rear panel connected to the respective first and second front panels to form, in conjunction with the first and second front panels, a pair of sleeves, wherein the first and second rear panels are joined together to form a pair of seams which define an elongated slot therebetween that is defined in turn by material between the pair of seams that is not joined together, wherein the first rear panel includes an edge that is overlapped by the second rear panel within the elongated slot to close the elongated slot;

a pair of intravenous access flaps each positioned with respect to a corresponding one of the pair of sleeves and closable via additional fasteners, wherein the pair of intravenous access flaps each includes a corresponding strip of twill material of a respective first and second color forming a backing for the additional fasteners, and wherein the first color is sufficiently different from the second color to thereby identify the corresponding sleeve; and a collar positioned only on the front of the hospital gown to identify the front of the hospital gown, wherein the collar is constructed from a fabric of a first color sewn to the first and second front panels and the remainder of the hospital gown is constructed of a fabric of a second color that is lighter than the first color.

12. The hospital gown of claim 11, wherein each of the pair of sleeves extends to a wrist of the patient when the gown is worn by the patient.

13. The hospital gown of claim 11, wherein the hospital gown is coated with an anti-microbial coating.

14. The hospital gown of claim 11, further comprising a radio frequency identification (RFID) tag.

15. The hospital gown of claim 11, wherein an additional slot is defined by the first and second rear panels below the pair of seams and below the elongated slot.

16. An adjustable front-opening hospital gown comprising:

a first front panel of a first blue fabric having a first set of plastic snap stud fasteners arranged in a single column of four rows;

a second front panel of the first blue fabric having a second set of plastic snap socket fasteners arranged in two columns of four rows, wherein the first front panel is configured to overlap part of the second front panel and thereby define a front of the hospital gown with respect to a patient when the hospital gown is worn by the patient, and wherein each of the first set of plastic snap stud fasteners is configured to engage with a corresponding one of the second set of plastic snap socket fasteners;

a first and a second rear panel of the first blue fabric joined together and connected to the first and second front panels, respectively, wherein the first and second rear panels include a pair of seams which define an elongated slot of between 10 to 14 inches between the first and second rear panels that is defined by material between the pair of seams that is not joined together, with one of the first and second rear panels including an edge that is overlapped by the other of the first and second rear panels within the elongated slot to close the elongated slot, and wherein the rear panel defines a pair of sleeves in conjunction with the first and second front panels;

a pair of intravenous access flaps each positioned with respect to a corresponding one of the sleeves, and including additional snap stud fasteners and snap socket fasteners backed by strips of twill material, wherein the strips of twill material on one of the pair of intravenous access flaps is white and the twill material on the other of the pair of intravenous access flaps is blue;

a telemetry pocket positioned on one of the first and second front panels, wherein the telemetry pocket covers a slit in the gown; and a V-shaped collar of a second blue fabric that is darker than the first blue fabric and positioned only on the front of the hospital gown to identify the front of the hospital gown, wherein the V-shaped collar is sewn to the first and second front panels.

* * * * *